United States Patent [19]

Zimmerman et al.

[11] 3,981,403

[45] Sept. 21, 1976

[54] OSCILLATING FREE SWINGING SIFTER APPARATUS

[75] Inventors: Otto J. Zimmerman, Oklahoma City; Walton L. Mock, Bethany, both of Okla.

[73] Assignee: Smico Corporation, Oklahoma City, Okla.

[22] Filed: Oct. 2, 1974

[21] Appl. No.: 511,387

[52] U.S. Cl. ..... 209/366.5; 209/415; 74/61

[51] Int. Cl.[2] ..... B07B 1/44

[58] Field of Search ..... 209/366, 366.5, 367, 209/332, 363, 364, 315, 415; 74/87, 61, 86

[56] References Cited

UNITED STATES PATENTS

| | | | |
|---|---|---|---|
| 533,724 | 2/1895 | Morse | 209/366 |
| 567,963 | 9/1896 | Dawson | 209/366 |
| 687,743 | 12/1901 | Green | 209/332 X |
| 1,142,146 | 6/1915 | Combs | 209/366.5 X |
| 1,222,903 | 4/1917 | Symons | 209/366 X |
| 1,327,636 | 1/1920 | Snyder | 74/87 X |
| 2,849,119 | 8/1958 | Guess | 209/366 X |
| 2,914,176 | 11/1959 | Norvell | 209/366.5 |
| 3,032,200 | 5/1902 | Miller | 209/366 |
| 3,076,549 | 2/1963 | Becker | 209/367 |
| 3,413,789 | 12/1968 | Studer | 74/61 X |
| 3,422,955 | 1/1969 | Mock | 209/366.5 X |
| 3,483,972 | 12/1969 | Elliot | 209/366 X |
| 3,794,165 | 2/1974 | Riesbeck | 209/332 X |
| 3,841,166 | 10/1974 | Gerberich | 74/61 |

*Primary Examiner*—Robert Halper

*Attorney, Agent, or Firm*—Laney, Dougherty, Hessin & Fish

[57] ABSTRACT

A free swinging sifter apparatus which includes a suspension framework, a sieve or sifter housing, suspension members suspending the housing from the framework, selectively positionable weights movably mounted on opposite sides of the housing and means for concurrently rotating the weights about substantially vertical axes.

22 Claims, 6 Drawing Figures

OSCILLATING FREE SWINGING SIFTER APPARATUS

BACKGROUND OF THE INVENTION

1. Field of the Invention

This invention relates to free swinging sifters which sift solid particulate material by undergoing gyratory movement to move the material through one or more sieves from the upper side of the sifter to one or more discharge points located on the lower side or bottom of the sifter.

2. Brief Description of the Prior Art

In U.S. Pat. No. 3,032,200, a sifter apparatus is described in which a sieve housing carrying a plurality of sieves is caused to undergo gyration by a plurality of heavy weights mounted on the opposite sides thereof, and driven in rotation about vertical axes by a drive motor mounted on the sifter housing. The weights are interconnected by a rigid tie bar. The rigidity of the tie bar which drivingly interconnects these weights results in mechanical malfunction at tiems when the arm is bent or distorted in shape. Moreover, the weights employed at opposite sides of the sieve housing are substantially fixed in their radius of rotation about their respective vertical axes, and thus are limited in the extent to which they may be moved or altered in their position to impart different gyratory characteristics to the sifter during the sifting operation.

Brief Description of the Present Invention

The present invention comprises an improved, efficient, free swinging sifter which can be used to effectively classify solid particulate materials by passage through one or a suspended series of vertically tiered sieves located within a sieve housing which can be selectively gyrated with no dependence upon the type of material to be sifted and the classification or separation requirements.

Broadly described, the free swinging sifter apparatus of the invention comprises sieve means, flexible means for vertically suspending the sieve means for free swinging movement, first weight means disposed alongside the sieve means in horizontally spaced relation thereto and mechanically connected to the sieve means, and second weight means spaced from the first weight means and spaced horizontally from the sieve means and mechanically connected to the sieve means. A prime mover is mounted on the sieve means at a location between and spaced from the first and second weight means, and flexible drive means is connected between the prime mover and each of the first and second weight means. Each of the weight means includes a weight which is operatively connected to the flexible drive means so that the respective weight may be driven in rotation about a vertical axis from which the weight is radially offset. The rotating movement of the weights in the first and second weight means causes the sieve means to which the weight means are mechanically connected to undergo a gyratory movement, thus effecting the desired sifting action.

In a preferred embodiment of the invention, each of the weight means comprises a weight housing pivotally supported on a vertical drive shaft so that the weight housing can pivot about a horizontal axis and, in doing so, change the radial distance between the weight housing and the vertical drive shaft upon which it is pivotally mounted. Further, in the preferred embodiment of the invention, each of the described weight housings is configured and constructed to accommodate weights selectively placed within the weight housing so that the force developed by the rotating weights hereinbefore described can be selectively varied, and the amplitude and frequency of gyratory movement can also be varied.

The flexible drive means employed for connecting the prime mover to the weights in the weight means preferably comprises a pair of flexible timing belts connected between the prime mover and each of the described drive shafts, with the prime mover employed preferably being a variable speed electric motor.

From the foregoing broad and general description of the invention, it will be apparent that a major object of the invention is to eliminate rigid drive members between the prime mover employed in a gyrating sifter and the weights used for imparting gyratory movement to the sifter.

A further important object of the invention is to provide a flexible belt drive in combination with a plurality of timing pulleys which provides a positive drive to rotating weights used for gyrating a sifter apparatus, which drive and pulleys are capable of maintaining in-phase synchronism of the rotating weights during high speed operation.

Another important object of the invention is to provide a free swinging sifter which can be caused to gyrate with selected and variable gyratory movements according to the type of material to be sifted and the type of classification or grading of the material desired.

Another object of the invention is to provide a safe, easily used and mechanically sturdy gyrating free swinging sifter which can be used to sift large quantities of particulate solid material passed through the sifter from the top to the bottom thereof.

Additional objects and advantages of the invention will become apparent as the following detailed description of a preferred embodiment of the invention is read in conjunction with the accompanying drawings which illustrate the invention.

DETAILED DESCRIPTION OF THE PREFERRED EMBODIMENT OF THE INVENTION

Figure 1:
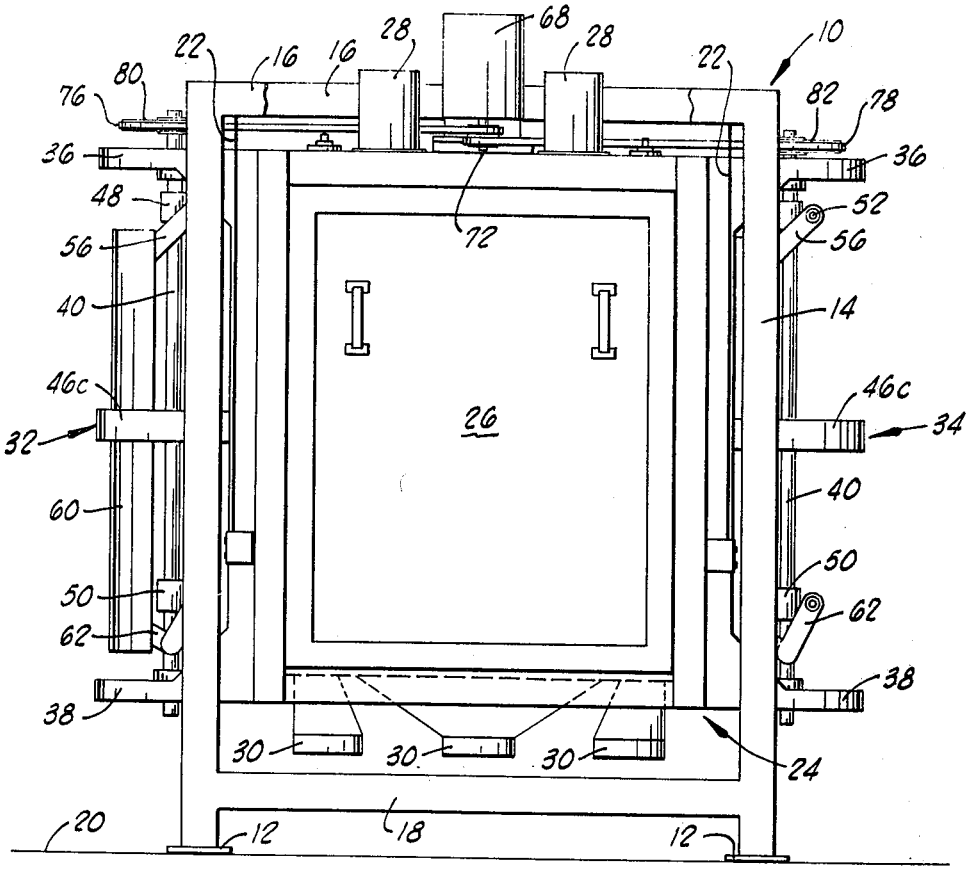
FIG. 1 is a side elevation view of the gyrating free swinging sifter apparatus of the invention.

Referring initially to FIG. 1 of the drawings, shown therein is one embodiment of a free swinging sifter apparatus constructed in accordance with the present invention. The sifter apparatus includes an upstanding suspension framework 10 which is of open box configuration and includes foot plates 12, vertically extending stanchions 14 located at the four opposite corners of the framework, horizontally extending upper frame members 16 and horizontally extending lower frame members 18. The suspension framework 10 is shown resting on a floor 20.

Suspended within the suspension framework 10 by means of a plurality of flexible cables 22 or other flexible members is a sieve housing 24 of generally right parallelepiped configuration. The sieve housing 24 has a door 26 at one side thereof to facilitate access to a plurality of vertically tiered sieves which are positioned inside the sieve housing. The arrangement of such sieves within the sieve housing 24 is conventional and forms no part of the present invention. Materials to be sifted and classified by passage through the sieves are admitted to the top of the sieve housing 24 through one or more inlet ducts 28 disposed on the upper side of the sieve housing. Material classified or graded by passage through the sieves within the sieve housing 24 is discharged through a plurality of discharge spouts 30 which project downwardly from the lower side of the sieve housing.

Figure 2:
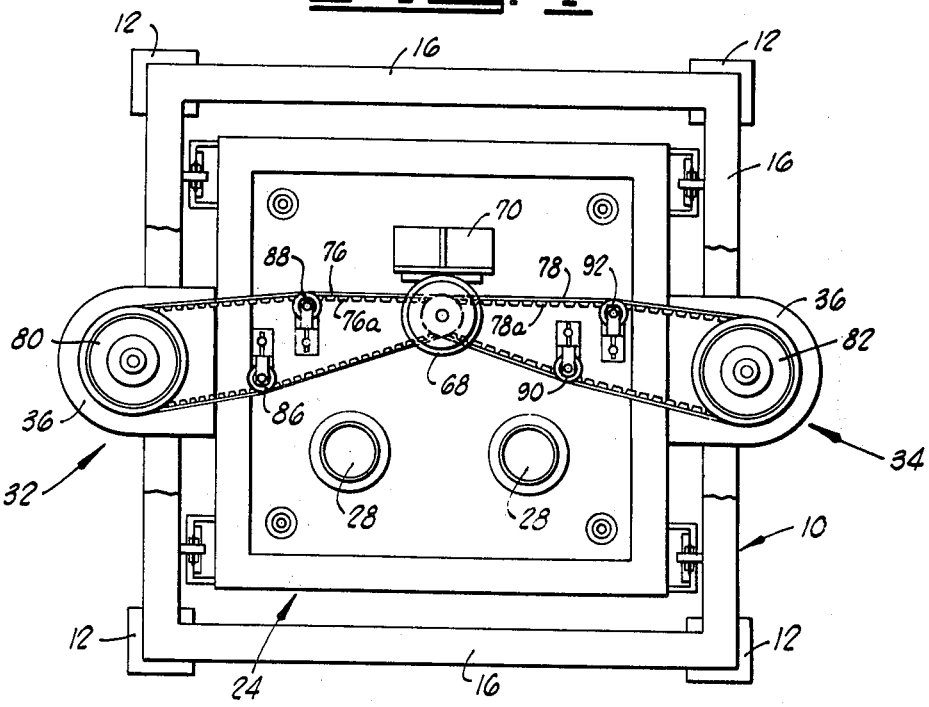
FIG. 2 is a plan view of the sifter apparatus.
Figure 3:
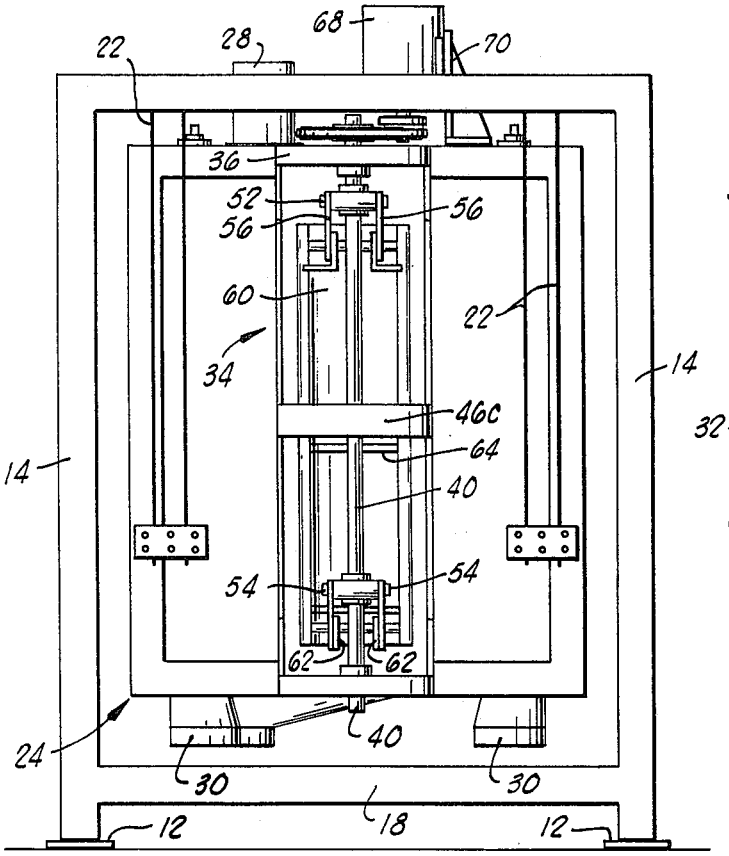
FIG. 3 is a side elevation view of the sifter apparatus shown in FIG. 1 and illustrating one of the weight means employed in the free swinging sifter apparatus of the invention.
Figure 4:
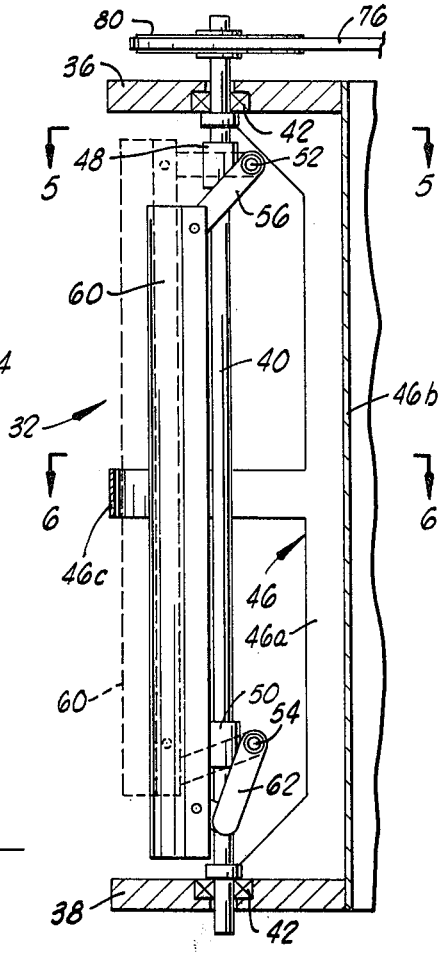
FIG. 4 is a detailed view showing one of the weight means in elevation, with the mounting brackets used for mounting the weight means on the side of the sieve housing illustrated in section.
Figure 5:
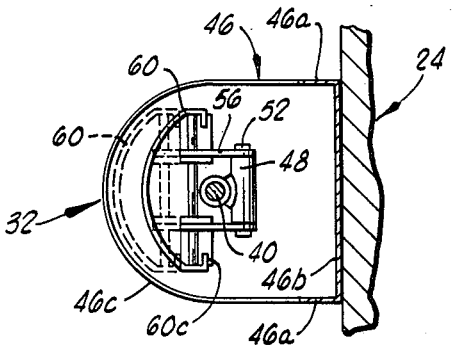
FIG. 5 is a sectional view taken along line 5—5 of FIG. 4.
Figure 6:
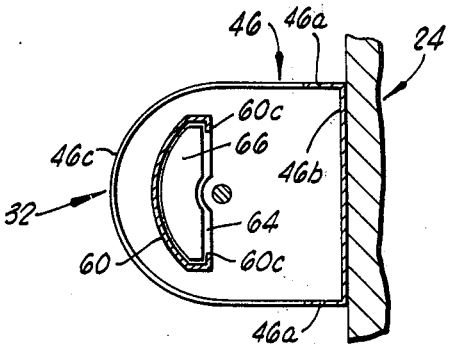
FIG. 6 is a sectional view taken along line 6—6 of FIG. 4.

In the illustrated embodiment of the invention, a pair of weight assemblies 32 and 34 are disposed on opposite sides of the sieve housing 24. The weight assemblies include a pair of vertically spaced, horizontally projecting bearing support brackets 36 and 38 positioned at a location substantially midway between the adjacent vertical frame members 14 of the frame 10. The bearing support brackets 36 and 38 are best illustrated in FIGS. 2 and 4 of the drawings. It will be noted in referring to FIG. 4 that each of the weight assemblies 32 and 34 includes a vertically extending drive shaft 40, the opposite ends of which project through suitable bearings 42 set in each of the bearing support brackets 36 and 38.

Each of the weight assemblies 32 and 34 is further provided with a metal shield and reinforcing member 46. The metal shield and reinforcing member 46 includes a pair of horizontally spaced, vertically extending side plates **46*a*, a back plate 46*b* secured against the side of the sieve housing 24 and having the bearing support brackets 36 and 38 secured thereto, and an arcuate central guard plate 46*c* which encircles both the drive shaft 40** and a weight housing pivotally carried thereon in the manner hereinafter described.

Keyed to each drive shaft 40 for rotation therewith are a pair of vertically spaced clevis brackets 48 and 50. Each clevis bracket includes a collar secured around the drive shaft 40 and a horizontally extending pivot hub secured to the collar. Projecting through the pivot hub of the upper clevis bracket 48 is a pivot pin 52 and a similar pivot pin 54 projects through the horizontally extending pivot hub of the lower clevis bracket 50. The protuberant opposite ends of the pivot pin 52 are connected to horizontally spaced, parallel links 56. The links 56 extend on opposite sides of the respective drive shaft 40 and have their ends opposite the ends connected to the pivot pin 52 secured inside the side portions of an arcuate weight housing 60.

Each arcuate weight housing 60 is an elongated, semi-cylindrical member which extends vertically and has its lower end connected to pair of L-shaped pivot links 62. The pivot links 62 extend parallel to each other on opposite sides of the respective drive shaft 40, and are secured at their ends opposite the ends connected to weight housing 60 to the pivot pin 54 extended through the pivot hub forming a part of the lower clevis bracket 50. The described structure permits each weight housing 60 to swing or pivot outwardly and upwardly from the full line position shown in FIG. 4, to the dashed line position shown in the same figure. Secured in each weight housing 60 at a point midway of its length is a horizontally extending shelf 64. The shelf 64 accommodates one or more weights 66 which are stacked on the shelf in vertically superimposed relation, and are retained on the shelf by a pair of in-turned flanges **60*c* which project toward each other from the opposite side edges of the respective semi-cylindrical weight housing 60. Additional shelves may be provided in each weight housing 60.**

Mounted on the upper side of the sieve housing 24 at the central portion thereof is an electric motor 68, which, in a preferred embodiment of the invention, is a variable speed motor. The motor 68 is supported in an inverted position by means of a bracket 70 secured to the top side of the sieve housing. A drive shaft 72 projects downwardly from the motor and has keyed thereto a pair of slotted timing belt drive pulleys which drivingly engage the bight portions at one end of each of a pair of timing belts 76 and 78. The timing belts 76 and 78 extend to and pass around driven timing pulleys 80 and 82, respectively, which are keyed to the upper ends of the drive shafts 40 in each weight assembly 32 and 34. It will be noted that each of the flexible timing belts 76 and 78 carries projecting teeth **76*a* and 78*a*, respectively, which teeth engage the slots or grooves formed in the periphery of the driven pulleys 80 and 82, and also engage slots or grooves formed in the periphery of the two drive pulleys keyed to the drive shaft 72 of the motor 68. The timing belts 76 and 78, though flexible, thus will not slip and will positively drive the drive shafts 40 of the weight assemblies 32 and 34.**

An important aspect of the present invention is the inclusion in the drive system which includes the motor 68, the drive pulleys, the driven timing pulleys 80 and 82 and the flexible timing belts 76 and 78, of a pair of idler timing pulleys used in association with each of the timing belts. Thus, a pair of idler timing pulleys 86 and 88 is adjustably mounted on the upper side of the sieve housing 24 at a location to engage the timing belt 76. As illustrated in FIG. 2 of the drawings, the idler timing pulleys 86 and 88 are positioned to force the opposed runs of the endless timing belt 76 outwardly, thus maintaining the belt in tension.

The location of the idler pulleys 86 and 88 in relation to the motor 68 and the driven timing pulley 80 has been found to be of importance in many types of sifter apparatus in which the present invention is incorporated. Thus, the pair of idler pulleys 86 and 88 should be positioned on the upper side of the sieve housing so that a line drawn parallel to the side of the sieve housing between the pair of idler timing pulleys is approximately equidistantly spaced from the drive shaft of the motor 68 and the axis of rotation of the driven pulley 80. It has also been found important with most larger types of free swinging sifter apparatus constructed in accordance with the invention to provide a pair of such idler pulleys for each of the flexible timing belts utilized. Thus, a pair of idler timing pulleys 90 and 92 is also provided on the opposite side of the sieve housing from the idler timing pulleys 86 and 88, and the former pulleys engage the timing belt 88, with the idler timing pulleys 90 and 92 being disposed at substantially the same relative locations in relation to the motor 68 and the driven timing pulley 82. The idler timing pulleys 86,

88, 90 and 92 are each mounted on brackets which are secured to the upper side of the sieve housing in a way to facilitate adjustment of position to a slight degree, as may be required, in a direction to tension the respective timing belts.

The idler timing pulleys 86, 88, 90 and 92 perform the important function of guiding the timing belts 76 and 78 as the timing belts run between flanges provided on opposite sides of central grooves carried around the periphery of each idler timing pulley and engaging the teeth 76*a* and 78*a* of the timing belts 76 and 78, respectively. Further, the idler timing pulleys have been found to be very important for achieving proper timing and synchronization of movement of the rotating weights carried in the two weight assemblies 32 and 34.

In one embodiment of the invention, the idler timing pulleys have a diameter of about 4¾ inches, and the driven pulleys have a diameter of about 13⅜ inches. The shaft 72 of the motor 68 is disposed a distance of about 41 inches from the driven timing pulleys 80 and 82.

Operation

In the operation of the gyrating free swinging sifter apparatus of the invention, a solid particulate material which is to be classified or graded into sized fractions is introduced to the sieves within the sieve housing 24 by passing the particulate solid material through the inlet ducts 28 at the top of the sieve housing. The material comes to rest upon the uppermost sieve contained within the sieve housing. After introducing the material to be sifted to the sieve housing 24 in this manner, the apparatus of the invention is started by energizing the electric motor 68. The motor can be caused to turn at a preselected speed since it is, in a preferred embodiment of the invention, a variable speed motor. Fixed speed motors can, of course, also be utilized. Energization of the motor 68 causes the drive shaft 72 thereof to rotate, and the drive belt pulleys carried on this drive shaft undergo rotation with the shaft.

The timing belt drive pulleys keyed to the drive shaft 72 carry serrations or notches which are peripherally spaced around the pulleys for purposes of engagement with the teeth 76*a* and 78*a* carried on the timing belts 76 and 78. This positive engagement prevents slipping of the belts so that a selected synchronism between the rotating weights carried at opposite sides of the sieve housing 24 can be maintained in the manner hereinafter described. The timing belts are tensioned and guided by means of the idller pulleys 86, 88, 90 and 92, which, as previously explained, can be easily shifted to disengage them from the timing belts at such time as may be desired, such as, for adjusting the position of the timing belts with respect to the driven timing pulleys 80 and 82 for a purpose hereinafter described in greater detail.

The idler timing pulleys 86, 88, 90 and 92 carry the described tooth-engaging serrations or notches and, due to the number of the idler pulleys and their strategic location, complement and aid the positive drive of the timing driving pulleys keyed to the drive shaft 72 and providing positive, non-slip engagement of the timing belts. This positive engagement prevents any slipping of the belts so that the selected synchronism between the rotating weights carried at opposite sides of the sieve housing 24 can be maintained in the manner hereinafter described. The timing belts are also tensioned and are guided and aligned by means of the idler pulleys 86, 88, 90 and 92.

The outer ends of the two timing belts 76 and 78 pass around the driven timing pulleys 80 and 82 which are keyed to the respective drive shafts 40 forming portions of the oppositely disposed weight assemblies 32 and 34. The driven timing pulleys 80 and 82 are also peripherally slotted with spaced slots or grooves to receive the teeth of the timing belts so that no slippage occurs.

As the timing belts are driven from the motor 68, the drive shafts 40 are driven in rotation. As the drive shafts 40 rotate about their respective longitudinal axes, a centrifugal force is applied to the two weight housings 60 through the respective intervening linkages. Stated differently, as one of the drive shafts 40 undergoes rotation, the weight housing 60 radially offset from the axis of the drive shaft can pivot outwardly and upwardly as a result of the pivotal connection between the respective weight housing and the drive shaft by means of the link 56 at the upper end of the weight housing and the link 62 at the lower end of the weight housing.

Outward movement of each weight housing 60 carries with it, of course, the weight or weights 66 which are carried therein on the weight shelves 64. How far the weight housings 60 and their respective weights 66 are caused to move outwardly away from the rotational axes of the drive shafts 40 will be dependent upon the speed at which the drive shafts are rotated, and the total amount of weight constituted by the weights 66. Both factors, or course, are subject to control and selection by the fixed or variable speed of the motor 68, and the ability to change the number of weights 66 carried on the shelf within the weight housing 60. It will be perceived in referring to each of the weight housings 60 that the construction with the shelf 64 and the inturned flanges 60*c*, holds the weights firmly in place once they have been turned end-wise to position them behind the respective drive shaft 40 and within the weight housing. It will further be noted that a protective and safety feature is provided by the inclusion of the sturdy metal shield and reinforcing member 46 around portions of the drive shafts 40 and weight housings 60, and particularly the inclusion of the guard plate 46*c* which surrounds the middle of each weight housing.

The rotational movement of the weight housing 60 and their respective weights 66 imparts a gyratory movement to the sieve housing 24 and the sieves carried therein. This gyrating motion effectively gyrates the solid particulate matter on the surface of the sieves carried therein and, in conjunction with gravity, forces the solid particulate material downwardly through the several sieves with an appropriate and desired sifting action. The timing belts 76 and 78 positively drive the two drive shafts 40 in rotation and, since the drive is positive and no slipping of these belts occurs, the phase relationship of the weight housings 60 and the weights 66 carried therein with respect to each other remains constant during operation of the apparatus.

It will be perceived that in the arrangement illustrated in FIGS. 1–4 of the drawings, the weight housing 60 shown on the left side of the apparatus in FIG. 1 is displaced farthest from the sieve housing 24, while the weight housing 60 toward the right of the sieve housing 24 and forming a part of the second weight means disposed at the side of the sieve housing is located substantially closer to the sieve housing than is the lefthand weight housing. This relative orientation between the weight housings and the weights they carry will be maintained by the positive drive of the timing belts 76 and 78 described. It will be seen, however, that should it be desirable to impart a different type of motion to the sieve housing 24 by reason of a different phase relationship between the pair of weight housings 60 and the weights carried thereby, this can be accomplished by alleviating the tension on one of the timing belts 76 or 78 by slightly moving the respective idler pulleys 86–92. The timing belt can then be slid around the respective slotted pulley 80 or 82 as the latter is rotated by hand to change the relationship between the weight housings and weights carried thereby. In this way, the positional and phase relationship of the weight housings and weights, during rotation about their respective vertical rotational axes, can be varied. Further, this control feature, coupled with the ability to change the distance by which the weight housings swing away from their vertical axes of rotation by varying the amount of weights 66 carried thereby enables a great variety of motions to be selectively imparted to the sieve 24. Thus, construction of the apparatus is such that it can be efficiently accommodated to various types of particulate materials to be sifted, and the particular type of sifting action obtained in any instance can also be varied.

The use of the flexible timing belts 76 and 78 imparts greater mechanical durability and a longer service life to the apparatus of the invention. The timing belts, while affording the desired positive drive, to not have a rigidity which makes them susceptible to malfunction upon undergoing extreme vibration and considerable stress during operation of the device.

Although a preferred embodiment of the invention has been herein described in order to illustrate the operating principles of the invention and the general construction thereof, it will be understood that various changes and innovations can be effected in the described structure without departure from such basic principles, and all changes and innovations which continue to rely upon these basic principles are therefore deemed to be within the spirit and scope of the invention except as the same may be necessarily limited by the appended claims or reasonable equivalents thereof.

What is claimed is:

1. A free swinging sifter apparatus comprising:

sieve means for classifying materials passed through the sieve means during movement thereof;

elongated flexible suspension means connected to said sieve means for vertically suspending the sieve means for free-swinging movement;

an upright suspension framework supporting said flexible suspension means and spaced from said sieve means to avoid contact by said sieve means with said suspension framework during free swinging movement of said sieve means;

first weight means disposed alongside the sieve means in horizontally spaced relation thereto and mechanically connected to the sieve means;

means pivotally supporting said first weight means from a side of said sieve means and affording mechanical connection between said first weight means and said sieve means, said pivotally supporting means being responsive to centrifugal force acting on said first weight means to undergo pivotation along with said weight means and allow said weight means to move further away from said sieve means;

second weight means spaced from the first weight means and spaced horizontally from said seive means alongside said sieve means and mechanically connected to the sieve means, said second weight means being disposed on the opposite side of said sieve means from said first weight means;

means pivotally supporting said second weight means from a side of said sieve means and affording mechanical connection between said second weight means and said sieve means, said means pivotally supporting said second weight means being responsive to centrifugal force acting on said second weight means during swinging movement of said sieve means to pivot outwardly with said second weight means as said second weight means is displaced further from said sieve means;

a prime mover mounted directly on said sieve means at a location between, and spaced from, said first and second weight means; and flexible drive means connected between the prime mover and each of said first and second weight means to drive each of said first and second weight means in rotation.

2. A sifter apparatus as defined in claim 1 wherein each of said first and second weight means comprises:

a weight movable in rotation about a vertical axis displaced horizontally from the sieve means; and drive shaft means connected between said flexible drive means and said weight for imparting said rotational movement to said weight.

3. A sifter apparatus as defined in claim 2 and further characterized in including:

a first pair of horizontally extending, vertically spaced, bearing support brackets connected to, and projecting horizontally from said sieve means, said first pair of brackets journaling opposite end portions of said drive shaft means of said first weight means at locations spaced from said sieve means; and a second pair of horizontally extending, vertically spaced, bearing support brackets connected to, and projecting horizontally from said sieve means, said second pair of brackets journaling opposite end portions of said drive shaft means of said second weight means at locations spaced from said sieve means.

4. A sifter apparatus as defined in claim 2 wherein each of said means pivotally supporting said first and second weight means from a side of said sieve comprises link means mounting said weight on said drive shaft means for rotation with said drive shaft means in a position radially displaced from the rotational axis of said drive shaft means.

5. A sifter apparatus as defined in claim 4 wherein each of said weight means is further characterized in including a weight housing connected to said link means and removably supporting said weight.

6. A sifter apparatus as defined in claim 4 wherein said link means comprises a plurality of links pivotally connected to said drive shaft mean for rotation therewith and concurrent pivotation about a horizontal axis, and privotally connected to said weight to pivot said weight about said horizontal axis when the links pivot about said horizontal axis whereby the weights undergo radial displacement from said drive shaft during the rotation thereof.

7. A sifter apparatus as defined in claim 6 wherein each of said weight means is further characterized in including a weight housing having said weight removably resting therein, and being pivotally connected to said links for pivotation about said horizontal axis.

8. A sifter apparatus as defined in claim 4 wherein said flexible drive means comprises a pair of flexible belts each having spaced, protuberant teeth therealong, and wherein said pulleys are slotted to receive and positively engage said teeth.

9. A sifter apparatus as defined in claim 1 wherein said flexible drive means comprises a pair of timing belts each drivingly connected between one of said weight means and said prime mover for actuating the two weight means in synchronism when said prime mover is energized.

10. A sifter apparatus as defined in claim 1 wherein said prime mover is a variable speed electric motor and said flexible drive means includes timing belts connected between the motor and the weight means for positively driving the weight means in non-slipping synchronism from the motor.

11. A sifter apparatus as defined in claim 1 wherein said sieve means comprises a sieve housing of rectangular parallelepiped configuration and said prime mover is mounted on the top of said sieve housing in substantially the center thereof.

12. A free swinging sifter apparatus comprising:

sieve means for classifying materials passed through the sieve means during movement thereof;

elongated flexible suspension means connected to said sieve means for vertically suspending the sieve means for free swinging movement;

first weight means disposed alongside the sieve means in horizontally spaced relation thereto and mechanically connected to said sieve means;

second weight means spaced from the first weight means and spaced horizontally from the sieve means and mechanically connected to the sieve means, said first and second weight means each comprising:

a metal shield and reinforcing member secured to said sieve means;

a pair of vertically spaced, horizontally extending bearing support brackets;

a vertically extending drive shaft having opposite end portions passing through, and journaled in, said bearing support brackets;

a weight-receiving weight housing pivotally connected to said drive shaft for swinging in an arc to positions of varying radial distance from said vertically extending drive shaft as centrifugal force moves said weight housing outwardly in pivotation on said drive shaft; and at least one pulley on an end of said drive shaft;

a prime mover mounted on the sieve means at a locations between, and spaced from, the first and second weight means; and flexible drive means connected between the prime mover and the pulleys carried on the ends of each of said drive shafts.

13. A sifter apparatus as defined in claim 12 and further characterized as including:

at least one clevis bracket mounted on said drive shaft for rotation therewith; and at least one link pivotally connected between said clevis bracket and said weight receiving housing.

14. A sifter apparatus as defined in claim 13 wherein said prime mover is a variable speed motor and said drive means comprises a pair of positively driven timing belts positively engaging said pulleys.

15. A sifter apparatus as defined in claim 14 wheren said metal shield and reinforcing member is further characterized in including an arcuate guard plate encircling said weight housing at the central portion thereof at a location outside the arc of swing of said weight housing.

16. A sifter apparatus as defined in claim 15 and further characterized as including an upright suspension framework having said flexible suspension means connected thereto and said sieve means hanging suspended in said framework.

17. A sifter apparatus as defined in claim 16 wherein said weight-receiving weight housing is semi-cylindrical in configuration and has in-turned flanges at the side edges thereof for retaining weights in the housing, and said apparatus further includes a horizontal weight supporting shelf in said weight housing.

18. A sifter apparatus as defined in claim 17 wherein each of said timing belts have spaced, protubarant teeth therealong, and wherein said pulleys are slotted to receive and positively engage said teeth.

19. A sifter apparatus as defined in claim 18 wherein said sieve means comprises a sieve housing of rectangular parallelepiped configuration, said metal shield and reinforcing members are mounted on opposite sides of said sieve housing and said motor is mounted on the top of said sieve housing in substantially the center thereof.

20. A gyrating, free swinging sifter apparatus comprising:

an upright suspension framework;

sieve means for classifying materials passed through the sieve means during gyratory movement thereof;

elongated flexible suspension members connected to said sieve means for vertically suspending the sieve means for free swinging movement;

first weight means disposed alongside the sieve means in horizontally spaced relation thereto and mechanically connected to the sieve means for pivotation about a horizontal axis;

second weight means spaced from the first weight means and spaced horizontally from the sieve means and mechanically connected to the sieve means for pivotation about a horizontal axis;

a prime mover mounted on the sieve means on the upper side thereof at a location between, and spaced from, the first and second weight means; and flexible belt means connected between the prime mover and each of said first and second weight means, said flexible belt means comprising:

a first driving timing pulley drivingly connected to said prime mover;

a second driving timing pulley drivingly connected to said prime mover;

a first endless flexible timing belt having a first bight portion drivingly and positively engaged by said first timing pulley and having a second bight portion;

a second endless flexible timing belt having a first bight portion drivingly and positively engaged by said second timing driving pulley and having a second bight portion;

a first driven pulley drivingly and positively engaged by said second bight portion of said first endless flexible timing belt and connected to said first weight means for driving a weight-carrying portion of said first weight means in rotation about a vertical axis;

a second driven pulley drivingly and positively engaged by said second bight portion of said second endless flexible timing belt and connected to said second weight means for driving a weight-carrying portion of said second weight means in rotation about a vertical axis;

a first pair of idler timing pulleys positively engaging the opposed runs of said first endless flexible timing belt at locations along the belt between said first and second bight portions; and a second pair of idler timing pulleys positively engaging the opposed runs of said second endless flexible timing belt between the first and second bight portions of said second endless flexible timing belt.

21. A gyrating, free swinging sifter apparatus as defined in claim 20 wherein said first pair of idler timing pulleys are adjustably mounted on the upper side of said sieve means.

22. A free swinging sifter apparatus comprising:

sieve means for classifying materials passed through the sieve means during movement thereof;

elongated flexible suspension means connected to said sieve means for vertically suspending the sieve means for free swinging movement;

an upright suspension framework having said flexible suspension means connected thereto and said sieve means hanging suspended in said framework;

first weight means disposed alongside the sieve means in horizontally spaced relation thereto and mechanically connected to the sieve means;

second weight means spaced horizontally from said first weight means, spaced horizontally from the sieve means and disposed on the opposite side thereof from said first weight means and mechanically connected to said sieve means, said first and second weight means comprising:

a pair of vertically spaced, horizontally extending bearing support brackets;

a vertically extending drive shaft having opposite end portions passing through, and journaled in, said bearing supporting brackets;

a weight-receiving weight housing;

link means pivotally supporting said weight housing on said drive shaft for pivotation of said weight housing about a horizontal axis in swinging movement of said weight housing in an arc to positions of varying radial distance from said vertically extending drive shaft; and a pulley on an end of said drive shaft;

a prime mover mounted on the sieve means at a location between, and horizontally spaced from, said first and second weight means; and flexible drive means connected between the prime mover and said pulleys on the ends of said drive shafts.

* * * * *